US005232129A

United States Patent [19]

Guerra

[11] Patent Number: 5,232,129

[45] Date of Patent: Aug. 3, 1993

[54] BEVERAGE DISPENSER STANCHION COVER

[75] Inventor: Jack A. Guerra, Mt. Clemens, Mich.

[73] Assignee: Regency Equipment Company, Mt. Clemens, Mich.

[21] Appl. No.: 882,858

[22] Filed: May 14, 1992

[51] Int. Cl.[5] ..... B67D 5/06

[52] U.S. Cl. ..... 222/183; 222/192; 137/375; D7/308; D7/313; D7/397

[58] Field of Search ..... 222/173, 183, 192, 78; 137/375, 382, 802; 40/332; D7/313, 397, 308, 312

[56] References Cited

U.S. PATENT DOCUMENTS

| | | | |
|---|---|---|---|
| D. 304,665 | 11/1989 | Start | D7/313 |
| D. 311,299 | 10/1990 | Start | D7/397 |
| D. 311,841 | 11/1990 | Start | D7/397 |
| 2,262,043 | 11/1941 | Perlick | 222/173 |
| 2,316,406 | 4/1943 | Cornelius | 137/375 X |
| 2,331,729 | 10/1943 | Rice | 137/375 X |
| 3,752,192 | 8/1973 | Kleppin | 222/183 X |

*Primary Examiner*—Gregory L. Huson
*Attorney, Agent, or Firm*—Basile and Hanlon

[57] ABSTRACT

A cover is disclosed for a beverage dispenser stanchion having a tap, an upper end and a lower end. The cover comprises a housing shaped to contain the beverage dispenser stanchion and having a tap receiving aperture, the tap being removably disposed within the tap receiving aperture. The housing comprises a base adapted to surround the stanchion lower end, a bottom portion releasably engageable with the base, a mid portion releasably engageable with the bottom portion, and a lid releasably engageable with the mid portion and adapted to surround the stanchion upper end. A mechanism is provided for removably mounting the housing to the stanchion.

5 Claims, 2 Drawing Sheets

BEVERAGE DISPENSER STANCHION COVER

BACKGROUND OF THE INVENTION

The present invention relates generally to beverage dispenser stanchion covers, and more particularly to such a cover which can quickly and easily be installed over an existing beverage dispenser stanchion.

Most beverage dispenser stanchions are of relatively simple construction, and not aesthetically pleasing to the eye. These stanchions, such as for draft beer and the like, are generally comprised of a simple cylindrical metal member having a tap attached thereto. Many bar and/or restaurant owners would appreciate having more elegant dispenser stanchions, especially ones which could match or complement the decor of the surroundings. However, these owners are reluctant to go to the time and expense involved in purchasing and installing a dedicated decorative stanchion. This can be expensive, as well as wasteful if the decor changes, or for any other reason the owner desired to change the stanchion. In that case, the entire dispenser stanchion would have to be removed and replaced, which can be costly and time consuming.

Thus, it is an object of the present invention to provide a beverage dispenser stanchion cover which fits over an existing stanchion and can advantageously be quickly, simply and inexpensively installed and removed and changed at will without need for specialized labor or tools.

SUMMARY OF THE INVENTION

The present invention addresses and solves all the problems enumerated above. The present invention comprises a cover for a beverage dispenser stanchion having a tap, an upper end and a lower end. The cover comprises a housing shaped to contain the beverage dispenser stanchion and having a tap receiving aperture, the tap being removably disposed within the tap receiving aperture. The housing comprises a base adapted to surround the stanchion lower end, a bottom portion releasably engageable with the base, a mid portion releasably engageable with the bottom portion, and a lid releasably engageable with the mid portion and adapted to surround the stanchion upper end. Means are provided for removably mounting the housing to the stanchion.

BRIEF DESCRIPTION OF THE DRAWINGS

Other objects, features and advantages of the present invention will become apparent by reference to the following detailed description and drawings, in which.

DETAILED DESCRIPTION OF THE PREFERRED EMBODIMENTS

Figure 1:
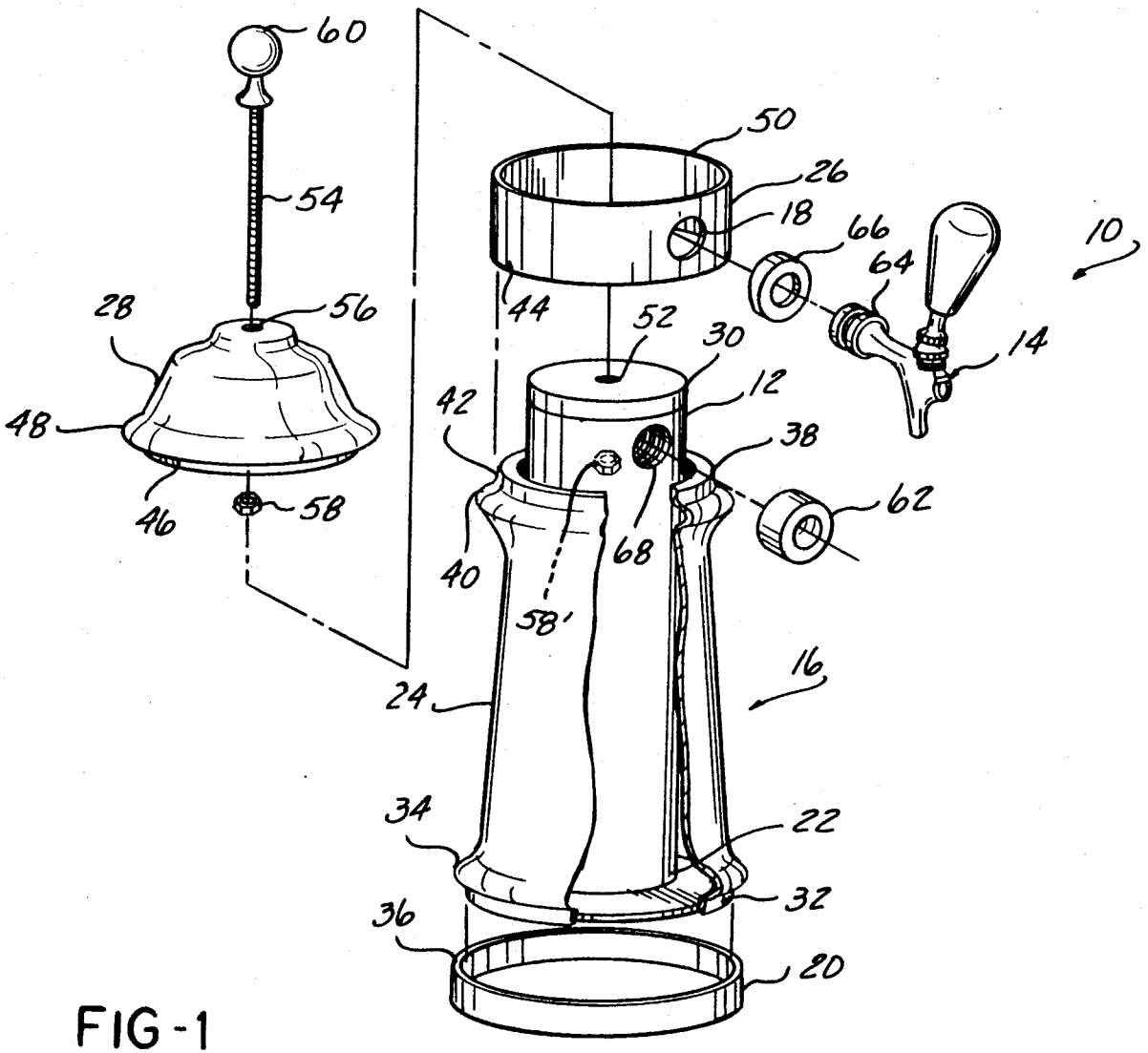
FIG. 1 is an exploded perspective view of the present invention, with part of the housing cutaway to show the beverage dispenser stanchion.

Referring now to FIG. 1, the cover of the present invention is designated generally as 10. Cover 10 is adapted to cover a beverage dispenser stanchion 12 having a tap 14. Cover comprises a housing 16 shaped to contain beverage dispenser stanchion 12 and having a tap receiving aperture 18, tap 14 being removably disposed within tap receiving aperture 18.

Housing 16 may be formed in any suitable shape, size or by any manufacturing methods conventionally known in the art. It can also be formed of any suitable material. In the preferred embodiment, the housing material is a combination of ceramic and metal. Also in the preferred embodiment, the housing comprises a base 20 adapted to surround the stanchion lower end 22. A bottom portion 24 is releasably engageable with base 20. A mid portion 26 is releasably engageable with bottom portion 24, and a lid 28 is releasably engageable with mid portion 26 and is adapted to surround stanchion upper end 30.

It is to be understood that the tap receiving aperture 18 may be disposed in any suitable area of housing 16, however, in the preferred embodiment, tap receiving aperture 18 is disposed within mid portion 26. Stanchion cover 10 further comprises means for removably mounting housing 16 to stanchion 12. It is to be further understood that this mounting means may comprise any suitable mounting means. However, in the preferred embodiment, the mounting means comprises a first inwardly offset flange 32 disposed on bottom portion 24 and having a first generally horizontal shoulder 34 defining its upper edge. First flange 32 is receivable within base 20, and first shoulder 34 abuts against an upper edge 36 of base 20.

A second inwardly offset flange 38 is disposed on bottom portion 24 at an end 42 distal from first flange 32. Second flange 38 has a second generally horizontal shoulder 40 defining its lower edge, the second flange 38 being receivable within mid portion 26, and second shoulder 40 abutting against a lower edge 44 of mid portion 26.

A third inwardly offset flange 46 is disposed on lid 28 and has a third generally horizontal shoulder 48 defining its upper edge. Third flange 46 is receivable within mid portion 26, and third shoulder 48 abuts against an upper edge 50 of mid portion 26.

Figure 2:
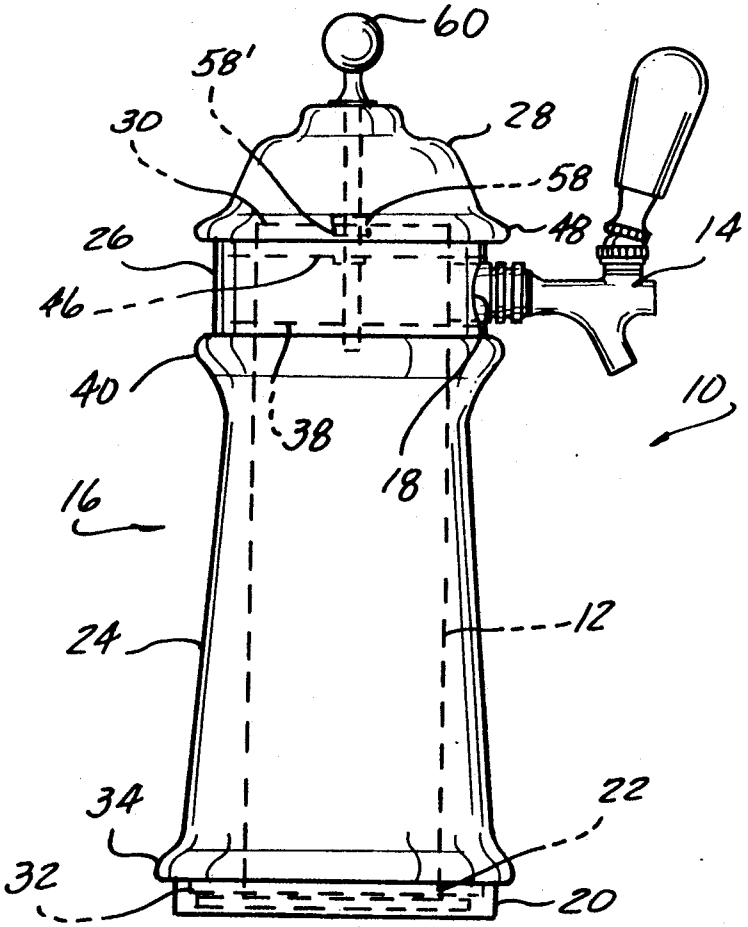
FIG. 2 is a side view showing the stanchion and the housing mounting means in hidden line.

A threaded bore 52 is defined in upper end 30 of stanchion 12 and lies in a plane parallel to a plane containing a longitudinal cross-section of stanchion 12. A screw 54 is threadingly engageable within threaded bore 52. Screw 54 is extendable through mid portion 26 and through a screw receiving aperture 56 in lid 28. A suitable fastener is threadingly engageable with screw 54, for securing screw 54 to stanchion 12. The fastener may comprise any suitable fastener conventionally known in the art, however, in the preferred embodiment, this fastener comprises nuts 58, 58'. A handle 60 is threadingly engageable with screw 54. Handle 60, upon threading engagement, as best seen in FIG. 2, is adapted to tightly secure lid 28, mid portion 26, bottom portion 24 and base 20 to each other via the respective flanges 32, 38, 46 and shoulders 34, 40, 48.

Flanges 32, 38 and 46 may be of any suitable size or shape, however, in the preferred embodiment, each of the flanges is an annular flange, as best seen in FIG. 1.

Stanchion cover 10 may further comprise a first spacer member 62, adapted to receive a connector member 64 for fluid communication between stanchion 12 and tap 14, and formed to extend between stanchion 12 and mid portion 26. A second spacer member 66 is adapted to receive connector member 64 and formed to extend between mid portion 26 and tap 14. Spacer members 62, 66 may be formed of any suitable material.

However, in the preferred embodiment, the spacer member material is formed of a suitable, deformably rigid polymeric material.

Stanchion cover 10 is a fast, simple and inexpensive way to surround various stanchions 12, such as for draft beer or other beverages with various decorative covers, as desired. In order to do this, tape 14 is removed from stanchion 12. Base 20, which comes in various sizes and shapes as needed, is placed over stanchion 12. Bottom portion 24 is placed over stanchion 12 and received within base 20 via flange 32 and shoulder 34. Mid portion 26 is placed over stanchion 12 and over bottom portion 24 via flange 38 and shoulder 40. If desired, spacer members 62, 66 are placed on either side of mid portion 26 and tap 14 is reattached to stanchion 12 by being placed first through spacer 66, tap receiving aperture 18, spacer 62 and threaded bore 68. Screw 54 is threadingly engaged within tapped threaded bore 52. Nuts 58, 58' are threadingly engaged with screw 54 against upper and lower edges of upper end 30 of stanchion 12, and secures screw 54 to stanchion 12. Lid 28 is placed over upper end 30 of stanchion 12 and is received within mid portion 26 via flange 46 and shoulder 48. Screw 54 extends through aperture 56 in lid 28.

The entire assembly is securely fastened together upon handle 60 being threadingly engaged with screw 54 and tightly secured to lid 28. The cover 10 in the assembled position is best seen in FIG. 2. This whole process can be accomplished within minutes. In order to remove cover 10, the process is repeated in reverse order.

Figure 3:
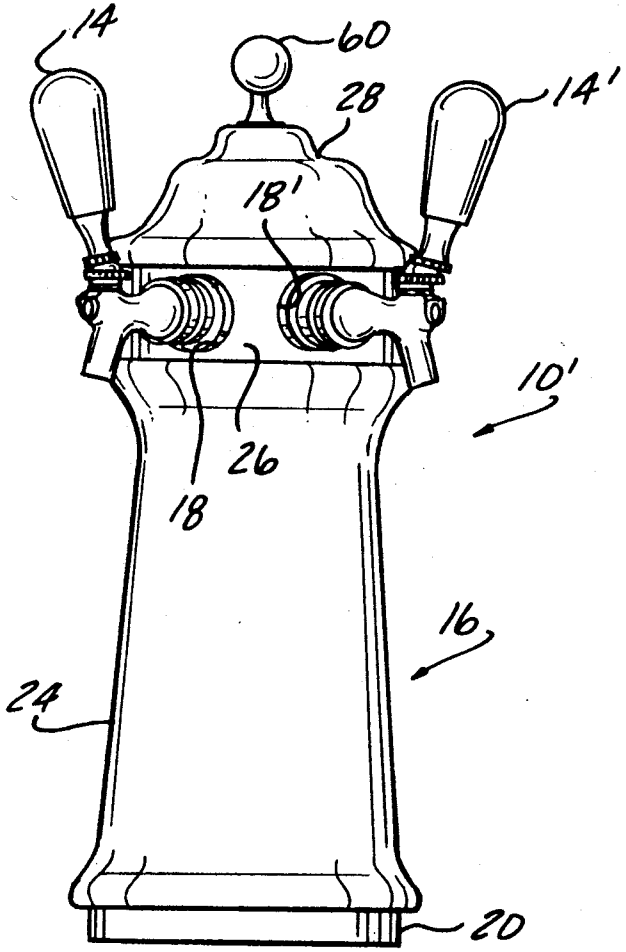
FIG. 3 is a front view of an alternate embodiment of the present invention shown in place on a dual-tap beverage dispenser stanchion.

FIG. 3 shows an alternate embodiment of the stanchion cover, designated generally as 10'. This embodiment is similar in all respects to the first embodiment, however, cover 10' is adapted to accommodate a dual tap 14, 14' beverage dispenser stanchion via two tap receiving apertures 18, 18'.

While preferred embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A cover for a beverage dispenser stanchion having a tap, an upper end and a lower end, the cover comprising;

a housing shaped to contain the beverage dispenser stanchion and having a tap receiving aperture, the tap being removably disposed within the tap receiving aperture, wherein the housing comprises:

a base adapted to surround the stanchion lower end;

a bottom portion releasably engageable with the base;

a mid portion releasably engageable with the bottom portion; and a lid releasably engageable with the mid portion and adapted to surround the stanchion upper end; and means for removably mounting the housing to the stanchion, wherein the mounting means comprises:

a first inwardly offset flange disposed on the bottom portion and having a first generally horizontal shoulder defining its upper edge, the first flange receivable within the base, and the first shoulder abutting against an upper edge of the base;

a second inwardly offset flange disposed on the bottom portion at an end distal from the first flange, the second flange having a second generally horizontal shoulder defining its lower edge, the second flange receivable within the mid portion, and the second shoulder abutting against a lower edge of the mid portion;

a third inwardly offset flange disposed on the lid and having a third generally horizontal shoulder defining its upper edge, the third flange receivable within the mid portion, and the third shoulder abutting against an upper edge of the mid portion;

a threaded bore defined in the upper end of the stanchion and lying in a plane parallel to a plane containing a longitudinal cross section of the stanchion;

a screw threadingly engageable within the threaded bore, the screw extendable through the mid portion and through a screw receiving aperture in the lid;

a fastener threadingly engageable with the screw, for securing the screw to the stanchion; and a handle threadingly engageable with the screw, wherein the handle, upon threading engagement, is adapted to tightly secure the lid, mid portion, bottom portion and base to each other via the respective flanges and shoulders.

2. The stanchion cover as defined in claim 1, wherein the tap receiving aperture is disposed within the mid portion.

3. The stanchion cover as defined in claim 1 wherein each of the flanges is annular.

4. The stanchion cover as defined in claim 1 wherein the tap has a connector member for fluid communication with the stanchion, the stanchion cover further comprising:

a first spacer member adapted to receive the connector member and formed to extend between the stanchion and the mid portion; and a second spacer member adapted to receive the connector member and formed to extend between the mid portion and the tap.

5. A cover for a beverage dispenser stanchion having a tap, an upper end and a lower end, the cover comprising:

a housing shaped to contain the beverage dispenser stanchion and having a tap receiving aperture, the tap being removably disposed within the tap receiving aperture, wherein the housing comprises:

a base adapted to surround the stanchion lower end;

a bottom portion releasably engageable with the base;

a mid portion releasably engageable with the bottom portion, the tap receiving aperture being disposed within the mid portion; and a lid releasably engageable with the mid portion and adapted to surround the stanchion upper end; and means for removably mounting the housing to the stanchion, wherein the mounting means comprises:

a first inwardly offset annular flange disposed on the bottom portion and having a first generally horizontal shoulder defining its upper edge, the first flange receivable within the base, and the first shoulder abutting against an upper edge of the base;

a second inwardly offset annular flange disposed on the bottom portion at an end distal from the first flange, the second flange having a second generally horizontal shoulder defining its lower edge, the second flange receivable within the mid portion, and the second shoulder abutting against a lower edge of the mid portion;

a third inwardly offset annular flange disposed on the lid and having a third generally horizontal shoulder defining its upper edge, the third flange receivable within the mid portion, and the third shoulder abutting against an upper edge of the mid portion;

a threaded bore defined in the upper end of the stanchion and lying in a plane parallel to a plane containing a longitudinal cross section of the stanchion;

a screw threadingly engageable within the threaded bore, the screw extendable through the mid portion and through a screw receiving aperture in the lid;

a fastener threadingly engageable with the screw, for securing the screw to the stanchion; and a handle threadingly engageable with the screw, wherein the handle, upon threading engagement, is adapted to tightly secure the lid, mid portion, bottom portion and base to each other via the respective flanges and shoulders.

* * * * *